US010167834B2

(12) United States Patent
Teike et al.

(10) Patent No.: US 10,167,834 B2
(45) Date of Patent: Jan. 1, 2019

(54) HIGH-PRESSURE FUEL PUMP INCLUDING A DISCHARGE VALVE WITH A VALVE BALL AND A VALVE BODY

(71) Applicant: Robert Bosch GmbH, Stuttgart (DE)

(72) Inventors: Gerd Teike, Ditzingen (DE); Michael Kleindl, Schwieberdingen (DE); Sebastian Peissner, Schorndorf (DE); Soeren Stritzel, Rayong (TH)

(73) Assignee: ROBERT BOSCH GMBH, Stuttgart (DE)

( * ) Notice: Subject to any disclaimer, the term of this patent is extended or adjusted under 35 U.S.C. 154(b) by 22 days.

(21) Appl. No.: 15/323,337

(22) PCT Filed: Feb. 20, 2015

(86) PCT No.: PCT/EP2015/053562
§ 371 (c)(1),
(2) Date: Dec. 30, 2016

(87) PCT Pub. No.: WO2015/158451
PCT Pub. Date: Oct. 22, 2015

(65) Prior Publication Data

US 2017/0159629 A1 Jun. 8, 2017

(30) Foreign Application Priority Data

Apr. 15, 2014 (DE) ..... 10 2014 207 194

(51) Int. Cl.
*F02M 59/46* (2006.01)
*F02M 63/00* (2006.01)

(52) U.S. Cl.
CPC ..... *F02M 59/462* (2013.01); *F02M 63/0036* (2013.01); *F02M 63/0071* (2013.01)

(58) Field of Classification Search
CPC ..... F02D 41/08; F02D 41/38; F02M 57/02; F02M 59/46; F02M 59/462;
(Continued)

(56) References Cited

U.S. PATENT DOCUMENTS 4,393,855 A * 7/1983 Mandar ..... F02M 3/045 123/585
6,135,090 A * 10/2000 Kawachi ..... F02D 41/3809 123/446
(Continued)

FOREIGN PATENT DOCUMENTS

DE 102011002826 7/2012
DE 102012017953 3/2014
(Continued)

OTHER PUBLICATIONS

International Search Report for PCT/EP2015/053562, dated Jun. 9, 2015.

*Primary Examiner* — Hung Q Nguyen
*Assistant Examiner* — Johnny H Hoang
(74) *Attorney, Agent, or Firm* — Norton Rose Fulbright US LLP; Gerard Messina

(57) ABSTRACT

A high-pressure fuel pump which includes a discharge valve with a valve ball and a valve body, the valve body having a sealing section on which a sealing seat is present, and having a guide section in which the valve ball is guided. The guide section includes a first plurality of axially protruding webs between which first flow paths are formed, an opening which faces radially outwardly being present at least between two adjacent webs.

14 Claims, 4 Drawing Sheets

(58) Field of Classification Search
CPC .... F02M 59/464; F02M 59/466; F02M 63/00; F02M 63/0036; F02M 63/0071
USPC ..... 123/495–499, 505, 506, 508
See application file for complete search history.

(56) References Cited

U.S. PATENT DOCUMENTS

| | | | | |
|---|---|---|---|---|
| 6,247,455 | B1 * | 6/2001 | Otake | F02B 75/243 123/435 |
| 7,540,274 | B2 * | 6/2009 | Yamada | F02M 37/04 123/506 |
| 2007/0068580 | A1 * | 3/2007 | Van Der Linden | F02M 59/462 137/539 |
| 2007/0113904 | A1 * | 5/2007 | Furuta | F02M 59/102 137/540 |
| 2009/0110575 | A1 * | 4/2009 | Munakata | B23K 11/16 417/437 |
| 2012/0251365 | A1 | 10/2012 | Ono | |
| 2013/0151052 | A1 * | 6/2013 | Fukuzawa | B60W 20/00 701/22 |
| 2015/0027416 | A1 * | 1/2015 | Brostrom | F02D 41/3845 123/495 |
| 2015/0337753 | A1 * | 11/2015 | Stickler | F02M 57/02 123/506 |

FOREIGN PATENT DOCUMENTS

| | | |
|---|---|---|
| EP | 2647827 | 10/2013 |
| GB | 444346 | 3/1936 |

* cited by examiner

HIGH-PRESSURE FUEL PUMP INCLUDING A DISCHARGE VALVE WITH A VALVE BALL AND A VALVE BODY

FIELD

The present invention relates to a high-pressure fuel pump.

BACKGROUND INFORMATION

High-pressure fuel pumps, in particular piston pumps for a fuel system for an internal combustion engine, are available in the market. Such high-pressure fuel pumps often include an inlet valve and a discharge valve which may open and close as a function of a control and/or as a function of a fuel pressure. The discharge valve allows a fuel accumulator ("rail") that is under pressure to close against a delivery space of the high-pressure fuel pump during a suction stroke. In contrast, if a fuel pressure in the delivery space exceeds a counterforce resulting from the pressure in the fuel accumulator, plus a closing spring force, the discharge valve may open.

SUMMARY

An object underlying the present invention is to provided high-pressure fuel pump. Advantageous embodiments and refinements are described herein. Features of the present invention are in the description below and in the figures; the features may be important for the present invention, alone or also in various combinations, without this being explicitly pointed out again.

The present invention relates to a high-pressure fuel pump which includes a discharge valve with a valve ball and a valve body, the valve body including a sealing section on which a sealing seat is present, and having a guide section in which the valve ball is guided. According to the present invention, the guide section includes a first plurality of axially protruding webs between which first flow paths are formed, an opening which faces radially outwardly being present at least between two adjacent webs. The webs may thus radially guide the valve ball without greatly hindering the hydraulic flow. In particular, the webs do not include a shared radially outer circumferential collar or the like. Fuel may thus flow through an area radially outside the webs when the discharge valve is open, as a result of which a hydraulic cross section is enlarged and the delivery capacity of the high-pressure fuel pump may be improved.

In one embodiment of the high-pressure fuel pump, the webs are designed as webs which axially protrude freely from the sealing section. The webs are thus connected, preferably in one piece, to the valve body only at one axial end section. The hydraulic cross section may be additionally improved in this way.

In addition, it may be provided that the webs have a circular segment-like cross section. A radial flow, having a particularly large cross section that is formed in the area of the webs may thus take place when the discharge valve is open. At the same time, a material cross section of the webs may be optimized, so that the fatigue strength may be improved. Alternatively, however, other cross sections, for example circular or polygonal cross sections, are conceivable.

In one embodiment of the high-pressure fuel pump, the valve body has a smaller outer diameter in the area of the guide section than in the area of the sealing section. For example, the valve body is situated in a housing of the high-pressure fuel pump, preferably pressed into same. A radial area between the webs and the housing may then advantageously be utilized for the hydraulic flow, as a result of which the hydraulic cross section may be further improved. In addition, due to the smaller outer diameter, the guide section may be decoupled from a radially outer pressing area on the valve body.

In another embodiment of the high-pressure fuel pump, the discharge valve includes a stop element for the valve ball, with a stop section which delimits the opening stroke of the valve ball, the stop element including a second plurality of radial recesses which are uniformly distributed in the circumferential direction and which form second flow paths, the cross-sectional areas and/or the second plurality of second flow paths being selected in such a way that, regardless of the radial orientation of the stop element, at least one second flow path at least partially overlaps a first flow path. A particularly advantageous configuration of the high-pressure fuel pump according to the present invention is thus described. In particular, installation of the valve body and the stop element may take place, regardless of a radial angle of these elements relative to one another, and may thus be simplified and the cost reduced.

Furthermore, it may be provided that a valve spring which acts on the valve ball with an axial force against the sealing seat is supported on the stop element. In particular, the stop element may have an approximately cup-shaped design in part, with the valve spring accommodated radially within the stop element. As a result, the discharge valve and thus the high-pressure fuel pump according to the present invention may have a particularly compact design.

In addition, it may be provided that the valve spring is designed as a coil spring, and in an axial direction has various diameters, in particular is fitted. The functioning of the valve spring may be improved in this way, in particular when the valve spring is accommodated radially within the stop element. In particular, due to the fitting, friction between the valve spring and the stop element may be reduced or even prevented, as the result of which the fatigue strength may be increased.

In one embodiment of the high-pressure fuel pump, the stop element and/or the valve body are/is manufactured according to a metal injection molding (MIM) process. The discharge valve may thus be manufactured particularly easily and cost-effectively.

In addition, it may be provided that the first plurality and the second plurality are different. As a result, in particular when the webs or the recesses are uniformly radially distributed, a radial "interference," so to speak, results between the first and the second flow paths, so that an overall hydraulic opening cross section that results is essentially independent of a radial angle between the guide section and the stop element. The functioning of the discharge valve is thus improved and the installation is simplified, since the elements do not have to be aligned in the circumferential direction.

As an alternative to manufacturing according to a metal injection molding process, the stop element may be designed in particular as a stamped part and/or deep-drawn part. It is thus possible to save on weight and to lower manufacturing costs.

Specific embodiments of the present invention are explained below by way of example with reference to the figures.

BRIEF DESCRIPTION OF THE DRAWINGS

The same reference numerals are used for functionally equivalent elements and dimensions in all figures, even for different specific embodiments.

DETAILED DESCRIPTION OF EXAMPLE EMBODIMENTS

Figure 1:
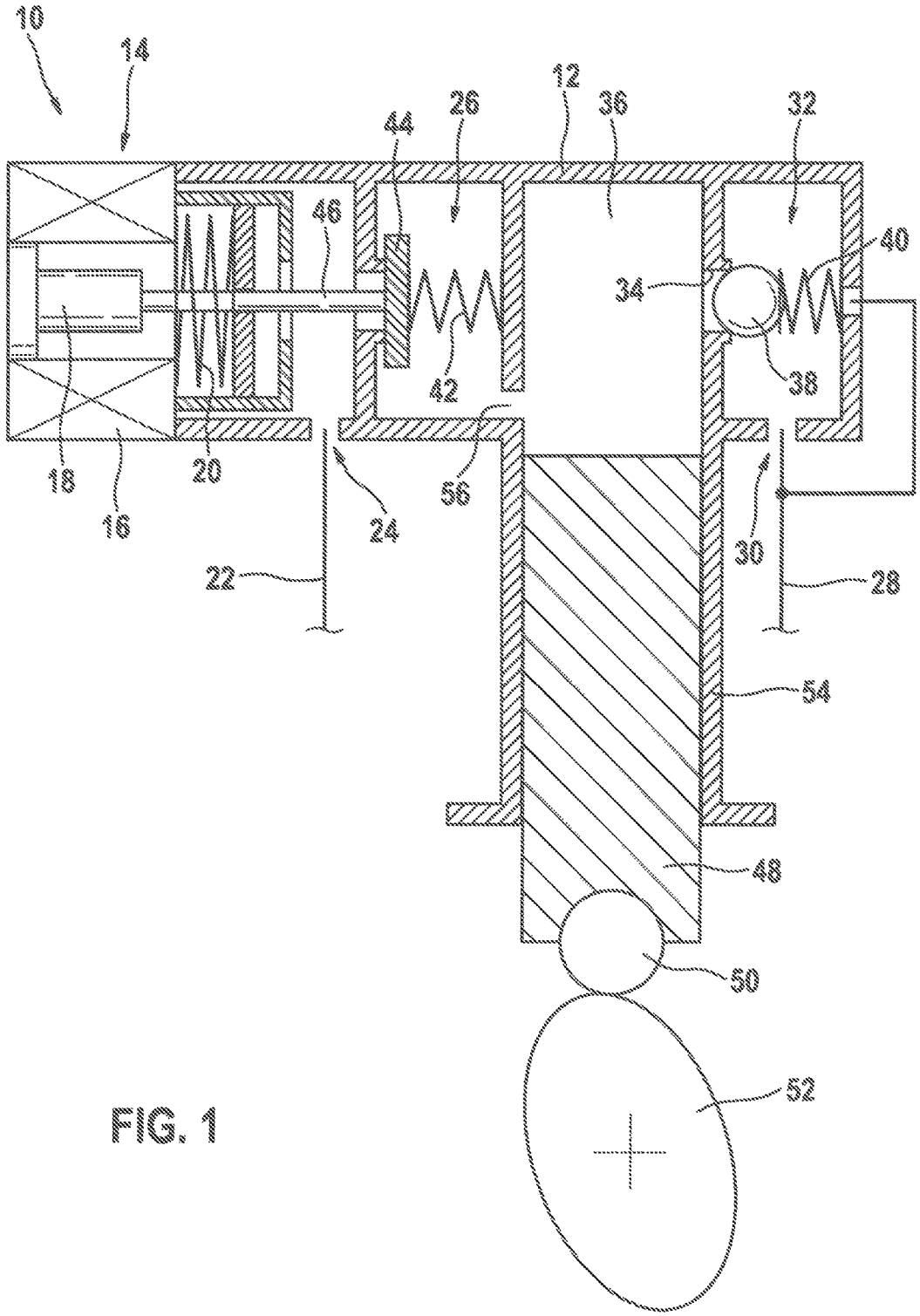
FIG. 1 shows a simplified diagram of a high-pressure fuel pump for an internal combustion engine, in a sectional representation.

FIG. 1 shows a simplified diagram of a high-pressure fuel pump 10 in an axial sectional representation. High-pressure fuel pump 10 is an element of a fuel system, not illustrated, of an internal combustion engine of a motor vehicle, not illustrated. High-pressure fuel pump 10 includes a housing 12, in whose section (on the left side of the drawing) an electromagnet 14 together with a solenoid 16, an armature 18, and an armature spring 20 are situated.

Figure 2:
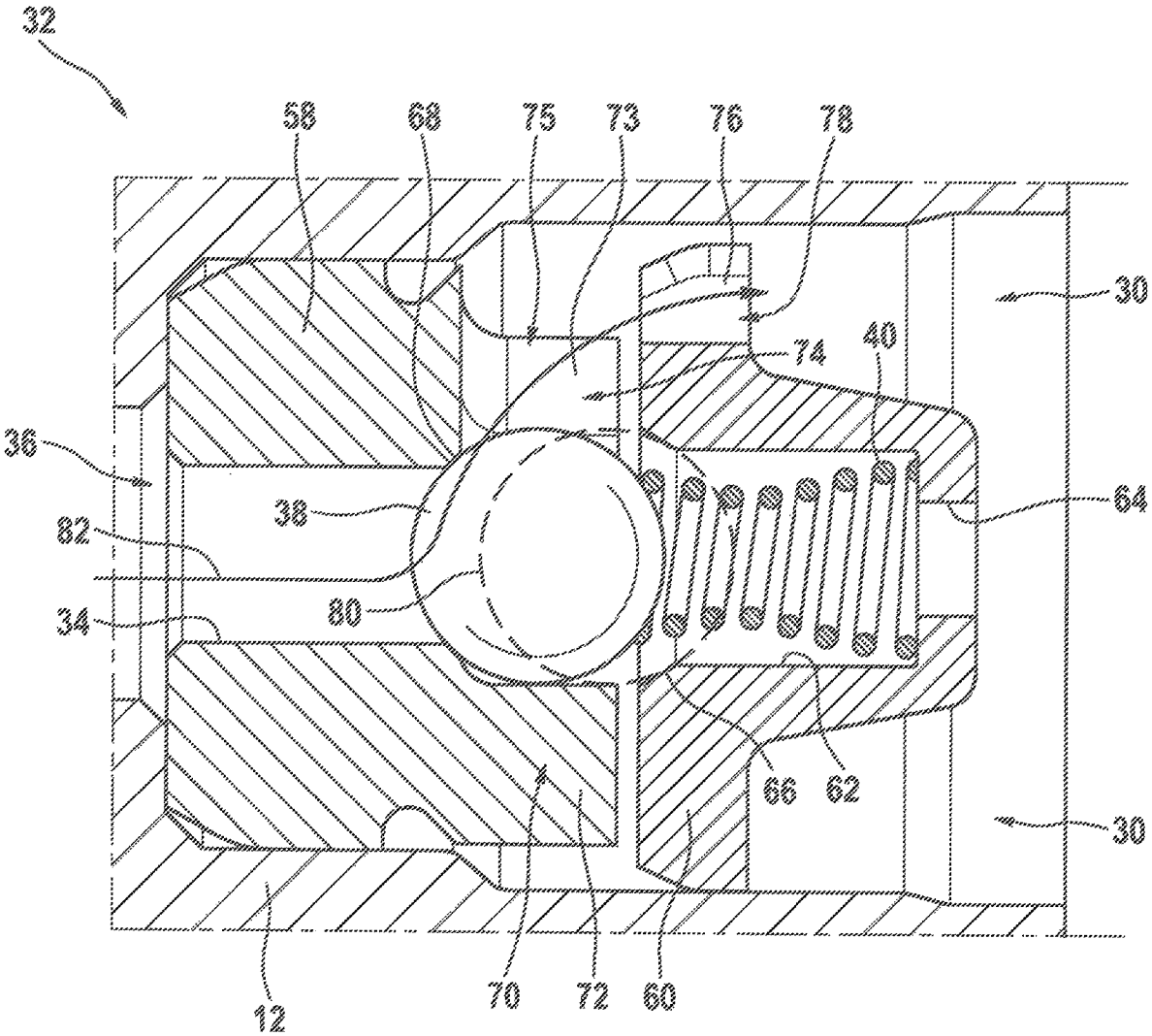
FIG. 2 shows a longitudinal section of a discharge valve of the high-pressure fuel pump from FIG. 1.
Figure 3:
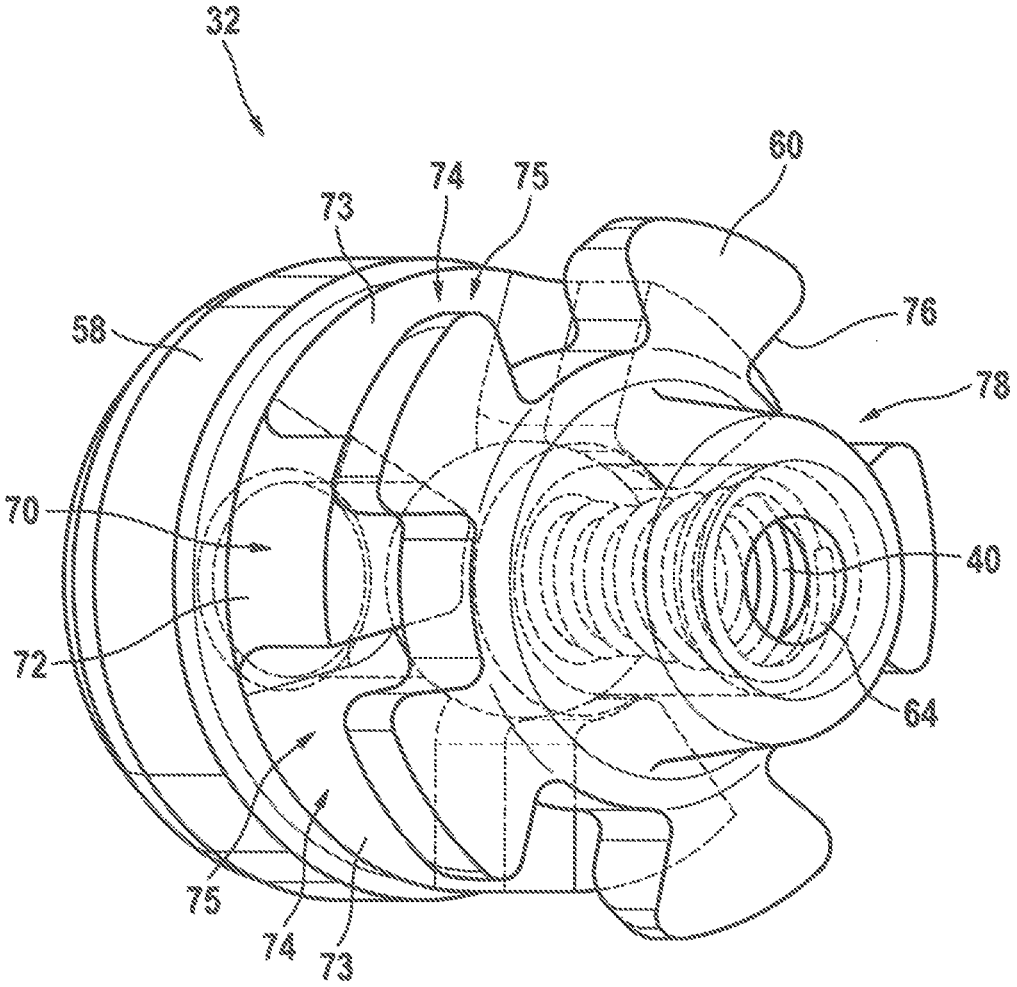
FIG. 3 shows a perspective illustration of a valve body and a stop element of the discharge valve, similar to FIG. 2, together with a valve ball and a valve spring.
Figure 4:
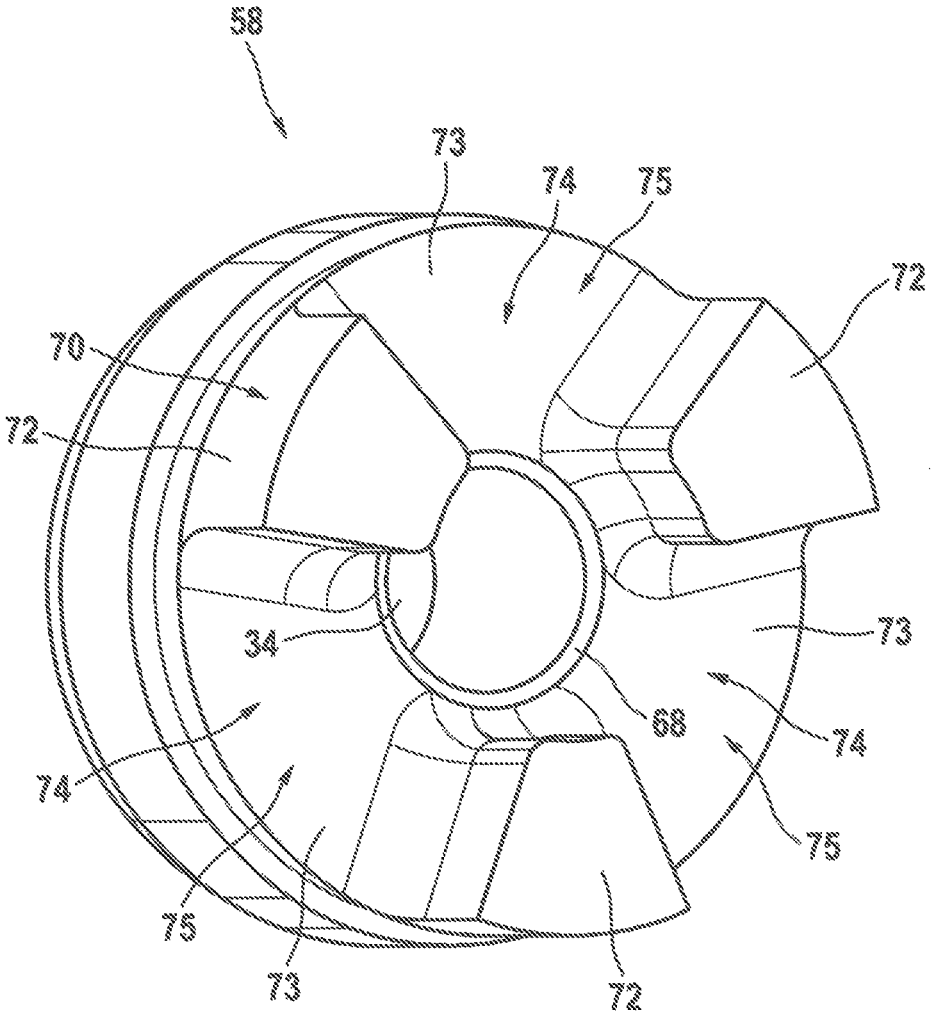
FIG. 4 shows a perspective illustration of the valve body from FIG. 3.

High-pressure fuel pump 10 also includes an inlet 24, which is connected to a low-pressure line 22, with an inlet valve 26, and an outlet 30 which is connected to a high-pressure line 28, with a discharge valve 32. A high-pressure accumulator ("rail") connected to high-pressure line 28 is not illustrated. In an open state, discharge valve 32 is hydraulically connected to a delivery space 36 via an opening 34. Discharge valve 32 includes a valve ball 38 and a valve spring 40, and is illustrated in FIG. 1 in only a highly schematic fashion. Discharge valve 32 is also shown in FIGS. 2, 3, and 4, and is described in greater detail below.

Inlet valve 26 includes a valve spring 42 and a valve body 44. Valve body 44 may be moved with the aid of a valve needle 46 which is displaceable horizontally in the drawing and coupled to armature 18. When electromagnet 14 is energized, valve needle 46 moves to the left in FIG. 1, and inlet valve 26 may thus be closed by the force of valve spring 42.

When electromagnet 14 is not energized, inlet valve 26 may be forcibly opened by the force of armature spring 20. A piston 48 which is situated in the drawing in delivery space 36 is vertically movable. Piston 48 may be moved in a cylinder 54 by a cam 52 (which is elliptical in the present case), with the aid of a roller 50. Cylinder 54 is formed in a section of housing 12. Inlet valve 26 is hydraulically connected to delivery space 36 via an opening 56.

During operation, high-pressure fuel pump 10 conveys fuel from inlet 24 to outlet 30, discharge valve 32 opening or closing, corresponding to a particular pressure difference between delivery space 36 and outlet 30 or high-pressure line 28. At full delivery, inlet valve 26 is acted on by a particular pressure difference between inlet 24 and delivery space 36, but at partial delivery is also acted on by valve needle 46 and electromagnet 14.

FIG. 2 shows an axial sectional representation of discharge valve 32, which is situated in housing 12 of high-pressure fuel pump 10. In principle, however, it is also conceivable for the housing of discharge valve 32 to be separate from housing 12 of high-pressure fuel pump 10. Discharge valve 32 has an essentially rotationally symmetrical or radially symmetrical design, and in the present case includes four elements: a valve body 58 (at the left in the figure), a stop element 60 (at the right in the figure), valve ball 38, which is situated axially centrally between valve body 58 and stop element 60, and valve spring 40, which is designed as a coil spring.

Valve spring 40 acts on valve ball 38 in the closing direction, and is accommodated in a recess 62 in stop element 60. Valve spring 40 is supported on a base (at the right in the figure, no reference numeral provided) of stop element 60. A radially inner delimiting surface of recess 62 forms a guide for valve spring 40. Recess 62 has a simple cylindrical cross section. The base has an axial central opening 64 which has a smaller diameter than valve spring 40. In the specific embodiment of discharge valve 32 illustrated in FIG. 2, valve spring 40 has a (continuously) differing diameter in an axial direction, and in the present case has a fitted design.

An edge of recess 62 in stop element 60 facing valve ball 38 forms a ring-shaped stop section 66 for valve ball 38. Stop element 60 thus delimits an opening stroke of valve ball 38 with the aid of stop section 66.

A linear ring-shaped sealing seat 68 is formed on valve body 58. Valve body 58 includes a guide section 70, to the right of sealing seat 68 in the drawing, in which valve ball 38 is radially guided. Guide section 70 includes a first plurality of axially protruding webs 72 which are uniformly distributed in the circumferential direction and used as a radial guide for valve ball 38. In particular, it is apparent that in the axial direction, webs 72 protrude freely from a sealing section which includes sealing seat 68; i.e., the webs are not enclosed, for example, by a shared collar or the like, which could possibly result in a bottleneck for the hydraulic flow.

Similarly, a first plurality of recesses 73 which form first flow paths 74 and an opening 75 leading radially outwardly from the interior of guide section 70 is radially present between webs 72. Guide section 70, similarly as for the first plurality of webs 72, has a radially symmetrical design in an axial area of first flow paths 74. In a radially outer area of webs 72 and of openings 75, an inner diameter of housing 12 is larger than in an area at the left in FIG. 2, resulting in a particularly large hydraulic cross section in the area of openings 75.

On its radially outer side, i.e., outside of recess 62, stop element 60 has a second plurality of recesses 76 which are uniformly distributed in the circumferential direction and which form second flow paths 78. Stop element 60 corresponding to the second plurality of recesses 76 has a radially symmetrical design in an axial area of second flow paths 78. In the present case, the first plurality and the second plurality are different, and have values of three and five, respectively (see FIGS. 3 and 4, explained below).

In FIG. 2, valve body 58 and stop element 60 are situated or provided at a small axial distance from one another (no reference numeral provided). In one specific embodiment of discharge valve 32 that is not shown, there is no axial distance between valve body 58 and stop element 60. Stop element 60 and/or valve body 58 are/is preferably situated in housing 12 with a force fit, for example by pressing a radially outer surface of stop element 60 or valve body 58 against a radially inner wall section of housing 12. It is understood that other techniques for situating stop element 60 and/or valve body 58 in housing 12 besides pressing are also possible according to the present invention.

In the specific embodiment according to FIG. 2, valve ball 38 is made of a steel material. In the present case, stop element 60 and valve body 58 are manufactured according to a metal injection molding (MIM) process. Alternatively, stop element 60 may be manufactured by stamping and deep-drawing. Overall, discharge valve 32 is dimensioned and designed in such a way that in an open state of discharge valve 32, a resulting hydraulic cross-sectional area is sufficiently large to convey a required fuel quantity with a comparatively low hydraulic flow resistance.

When, during operation of high-pressure fuel pump 10, a fuel pressure in delivery space 36 or in an area of opening 34 is less than a fuel pressure in an area of recess 62 plus the force of valve spring 40, valve ball 38 is pressed against sealing seat 68, to the left in the drawing. Discharge valve 32 is thus closed.

In contrast, if the fuel pressure in the area of opening 34 is greater than the fuel pressure in the area of recess 62 plus the force of valve spring 40, valve ball 38 may lift off from sealing seat 68, to the right in the figure. Discharge valve 32 is thus open.

If the fuel pressure in the area of opening 34 is sufficiently great, valve ball 38 may be maximally pressed all the way to stop section 66, to the right in the drawing. This results in a "travel limitation" for valve ball 38. A circle 80 illustrated in dashed lines indicates the position of valve ball 38 in this extreme case. It is apparent that valve body 58 and stop element 60 allow radial guiding of valve ball 38 (also see FIGS. 3 and 4, explained below).

An arrow 82 depicts a resulting flow of the fuel when discharge valve 32 is open. The flow takes place from left to right in the drawing, through opening 34, then past valve ball 38, then initially partially radially outwardly through openings 75, and partially directly through first flow paths 74 in valve body 58, then through second flow paths 78 in stop element 60, then into high-pressure line 28 and to the high-pressure accumulator, not illustrated. In particular, with the aid of freely protruding webs 72 formed on valve body 58 a particularly large hydraulic cross section is made possible when discharge valve 32 is open.

FIG. 3 shows a perspective illustration of discharge valve 32. FIG. 4 shows a view of valve body 58 alone, similar to the view in FIG. 3. It is apparent that valve body 58 has a radially symmetrical design in an area of guide section 70, and in the present case includes three axially protruding webs 72, and correspondingly, three first flow paths 74 and three openings 75. It is clearly apparent in FIG. 4 that webs 72 have a circular segment-like cross section.

Unlike the specific embodiment shown in FIG. 2, it is apparent in FIGS. 3 and 4 that valve body 58 has a smaller outer diameter in the area of guide section 70 than in the area of the sealing section which includes sealing seat 68. Fuel may thus flow radially outwardly around webs 72, so that an improved hydraulic cross section may result when discharge valve 32 is open. In addition, due to the smaller outer diameter, guide section 70 may be decoupled from a radially outer area of valve body 58 at which valve body 58 is situated in housing 12, in particular pressed into same. Stop element 60 likewise has a radially symmetrical design in an area of recesses 76, and in the present case includes five second flow paths 78; for the sake of clarity, only one of the second flow paths is provided with a reference numeral.

First, the cross-sectional areas of second flow paths 78 are selected in such a way that, regardless of the radial orientation of stop element 60 relative to valve body 58, at least one of second flow paths 78 at least partially overlaps one of first flow paths 74. Second, due to the first plurality and the second plurality being different, a radial "interference," so to speak, results between the three first flow paths 74 and the five second flow paths 78. An overall hydraulic opening cross section of discharge valve 32 that results is generally independent of an incidental radial mounting angle between guide section 70 and stop element 60.

What is claimed is:

1. A high-pressure fuel pump, comprising:
- a discharge valve that includes:
  - a valve ball; and
  - a valve body that includes:
    - a sealing section on which a sealing seat is present, and
    - a guide section in which the valve ball is guided;
- wherein:
  - the guide section includes a plurality of axially protruding webs between which first flow paths are formed; and
  - an opening, which faces radially outwardly, is present between two adjacent ones of the webs.

2. The high-pressure fuel pump as recited in claim 1, wherein the webs protrude freely from the sealing section.

3. The high-pressure fuel pump as recited in claim 1, wherein the webs have a circular segment-like cross section.

4. The high-pressure fuel pump as recited in claim 1, wherein an outer diameter of the valve body is smaller in an area of the guide section than in an area of the sealing section.

5. The high-pressure fuel pump as recited in claim 1, wherein:
- the discharge valve includes a stop element for the valve ball;
- the stop element includes:
  - a stop section which delimits an opening stroke of the valve ball, and
  - a plurality of radial recesses which are uniformly distributed in a circumferential direction and which form second flow paths; and
- the second flow paths are designed such that, regardless of a radial orientation of the stop element, at least one of the second flow paths at least partially overlaps a first one of the flow paths.

6. The high-pressure fuel pump as recited in claim 5, wherein the at least one of the second flow paths at least partially overlaps a first one of the flow paths regardless of the radial orientation of the stop element due to a design of a cross-sectional area of the at least one of the second flow paths.

7. The high-pressure fuel pump as recited in claim 5, further comprising a valve spring supported on the stop element.

8. The high-pressure fuel pump as recited in claim 7, wherein the valve spring is designed as a coil spring whose diameter varies in an axial direction.

9. The high-pressure fuel pump as recited in claim 5, wherein the stop element is manufactured according to a metal injection molding (MIM) process.

10. The high-pressure fuel pump as recited in claim 5, wherein the first flow paths are formed by recesses and there are a different number of the recesses forming the first flow paths than of the recesses forming the second flow paths.

11. The high-pressure fuel pump as recited in claim 1, wherein the valve body is manufactured according to a metal injection molding (MIM) process.

12. The high-pressure fuel pump as recited in claim 5, wherein the stop element is designed as a stamped part.

13. The high-pressure fuel pump as recited in claim 5, wherein the stop element is designed as a deep-drawn part.

14. The high-pressure fuel pump as recited in claim 5, wherein the sealing section and the guiding section are integrally formed.

* * * * *